United States Patent [19]

Morey

[11] Patent Number: 4,771,953

[45] Date of Patent: Sep. 20, 1988

[54] RETRACTABLE ANVIL CHIPPER

[75] Inventor: Norval K. Morey, Weidman, Mich.

[73] Assignee: Morbark Industries, Inc., Winn, Mich.

[21] Appl. No.: 15,681

[22] Filed: Feb. 17, 1987

[51] Int. Cl.[4] ..... B02C 13/02

[52] U.S. Cl. ..... 241/101.7; 241/186 R; 241/222; 241/239; 241/286

[58] Field of Search ..... 144/176; 241/101.7, 241/186 R, 222, 223, 239, 240, 241, 280, 281, 286

[56] References Cited

U.S. PATENT DOCUMENTS

| | | | |
|---|---|---|---|
| Re. 31,048 | 10/1982 | Smith | 241/281 |
| 384,763 | 6/1888 | Hayes . | |
| 2,034,951 | 3/1936 | McArdle et al. | 83/62 |
| 2,682,996 | 7/1954 | Forman | 241/239 |
| 2,712,842 | 7/1955 | Fahrni | 144/162 |
| 2,936,008 | 4/1957 | Brown | 144/162 |
| 3,524,485 | 8/1970 | Smith | 144/176 |
| 3,559,898 | 2/1971 | Rinke | 241/101 |
| 3,570,773 | 3/1971 | Schneider et al. | 241/81 |
| 3,661,333 | 5/1972 | Smith | 241/281 |
| 3,861,602 | 1/1975 | Smith | 241/92 |
| 3,863,848 | 2/1975 | Mashuda | 241/101 |
| 3,913,643 | 10/1975 | Lambert | 144/172 |
| 3,955,765 | 5/1976 | Gaitten | 241/28 |
| 4,057,192 | 11/1977 | Smith | 241/92 |
| 4,078,590 | 3/1978 | Smith | 144/176 |
| 4,184,526 | 1/1980 | Hanaya | 144/235 |
| 4,254,874 | 3/1981 | Arnoldsson et al. | 209/3 |

FOREIGN PATENT DOCUMENTS

| | | |
|---|---|---|
| 829043 | 10/1977 | U.S.S.R. . |
| 654214 | 10/1977 | U.S.S.R. . |
| 729056 | 12/1977 | U.S.S.R. . |

*Primary Examiner*—Timothy V. Eley

*Attorney, Agent, or Firm*—Price, Heneveld, Cooper, DeWitt & Litton

[57] ABSTRACT

A wood and stump chipper having a rotational chipper disc with protruding blade means for chipping wood advanced thereto; a support trough for wood; a ram for advancing wood along the support trough to the disc; power means for shifting said ram from a position spaced from said disc to a position adjacent said disc and return; and an anvil positionable adjacent the disc for cooperation therewith in chipping wood; the anvil being shiftable in a support between an extended position adjacent the disc and a retracted position away from the disc in a dimension transverse to the dimension of ram movement so as to move out of the path of the ram; and power means for shifting the anvil adjacent the disc when the ram is spaced from the disc and for shifting the anvil away from the disc and out of the path of the ram when the ram approaches the disc.

14 Claims, 2 Drawing Sheets

RETRACTABLE ANVIL CHIPPER

BACKGROUND OF THE INVENTION

This invention relates to a stump and wood chipping disintegrator.

Clearing of wooded terrain for building construction or highway purposes has been greatly aided in recent years by the development of practical tree chipping equipment such as in U.S. Pat. Nos. 4,057,192, Re. 31,048 and 3,805,860 and brush chipping equipment as in U.S. Pat. No. 3,861,602. The trunks, limbs and tops of trees and brush can be chipped for fuel, paper manufacturing, chipboard fabrication and other uses. Alternatively, tree trunks can be separated for making lumber and plywood, while the branches and tops are chipped for fuel or the like.

In copending application Ser. No. 900,448 filed Aug. 26, 1986, and entitled STUMP DISINTEGRATOR is disclosed unique apparatus for processing stumps into chips. This allows on site disintegration into combustible fuel material or the like so as to avoid the undesirable and expensive disposal techniques of stump burning or hauling to landfills.

As noted in the above identified copending application, wood other than stumps can also be processed in the apparatus. Regardless of the form of wood material processed, an anvil is provided to cooperate with the revolving disc and blades for chipping. This effects a fixed surface for restraining the material against rotation and against which the blades act to cause the wood to be chipped.

However, when stumps are chipped, it has been found that, at the end of the ram stroke where the ram is still several inches from the blades, the interconnected radiating root portions of huge stumps will sometimes remain in "spread eagle" position across the face of the disc. Subsequent withdrawal of the reversed ram away from the disc does not necessarily cause this octopus-like structure to break free and tip over, so that the radiating root structure can prevent use of the machine until removed from the disc. Such removal of these huge portions can be difficult and time consuming.

The present invention was conceived and developed to prevent this condition from occurring, or in the event it does occur, to cause the machine itself to remedy the situation. It constitutes an improvement on the apparatus in the noted copending application Ser. No. 900,448 filed Aug. 26, 1986 and incorporated herein by reference.

SUMMARY OF THE INVENTION

The present invention provides a disintegrator capable of enabling grubbed out stumps and other wood to be quickly and economically converted into chips, without the root sections remaining on the face of the disc to jam the apparatus.

The chipper disintegrator has a special retractable-extendible anvil that is shiftable between a position adjacent the disc and a position retracted away from the disc. In the position adjacent the disc, the anvil cooperates to restrain the stumps, etc. from rotating with the blades and form a fixed surface to cooperate with the blades. In the retracted position, the anvil is out of the path of the ram, enabling the residual stump structure and other material to rotate sufficiently to fall away from the face of the disc.

The combination stump disintegrator therefore has a trough forming a stump support, a chipping disc at one end of the trough with chipping blades projecting from the face at varying radial distances from the rotational axis of the disc, an axially movable driven ram movable from the other end of the trough for forcing stumps toward the disc, and a radially projecting stabilizer anvil movable radially between a position adjacent the disc and a second portion retracted out of the trough and away from the disc. The anvil is preferably radially movable along a fixed anvil support track by a power motor such as a fluid cylinder acting through a connecting linkage.

These and other objects, advantages and features will become apparent upon studying the following detailed specification along with the drawings.

DESCRIPTION OF THE PREFERRED EMBODIMENTS

Assembly

Figure 2:
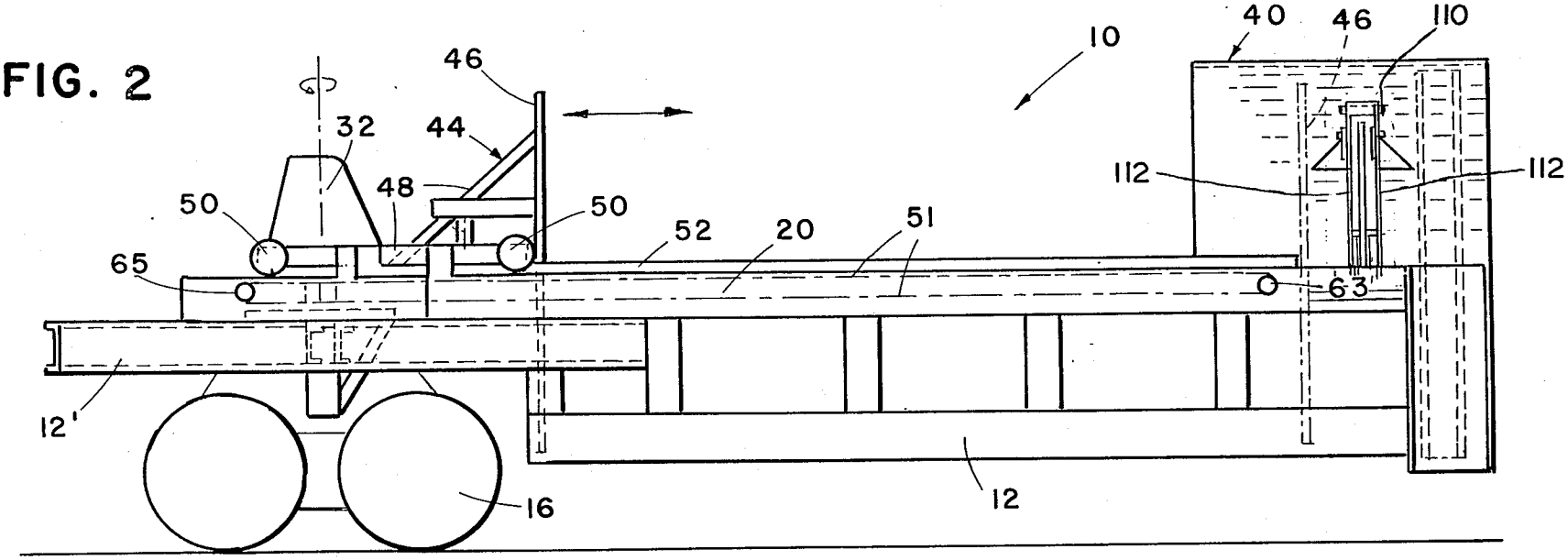
FIG. 2 is a side elevational view of the disintegrator employing this invention.

Referring specifically to the drawings, the stump disintegrator assembly 10 there depicted includes the basic components set forth in copending application Ser. No. 900,448, incorporated by reference herein. It is shown mounted on a frame 12 which comprises the bed of a truck trailer. This frame has an elevated rear portion 12' beneath which a conventional suspension system 14 and wheels 16 are mounted. The frame also includes an elevated front portion 12" which includes a conventional hitch such as a fifth wheel king pin for attachment to a fifth wheel or the like on a truck tractor (not shown).

Mounted on frame 12 is an elongated, front to rear, semicylindrical stump support trough 20 extending in the axial direction of the trailer. This trough has an open top for receiving stumps, large chunks of tree trunks or the like. These are placed by a rotational hoist or crane 24 preferably mounted on capstan 32 which is on frame 12' as depicted. This crane includes an articulated beam 26 with clamping tongs 28 operated remotely from a cab 30 and movable in three dimensions about capstan 32.

At the front of the trough is a chipper subassembly 40 (explained hereinafter) operated by a drive motor subassembly 42. The drive subassembly 42 includes a large internal combustion engine 41 of sufficient capacity to operate chipper subassembly 40, the auger, and the hydraulic system to the crane. The drive connection from the engine to chipper subassembly 40 is a suitable gear box, pulleys and belts, hydraulic motors, or the equivalent, the purpose being to rotate the chipper disc assembly on its central axis supported on suitable pillow block bearings.

Ram Subassembly

A ram subassembly 44 includes ram plate 46 having a lower portion generally matching the configuration of trough 20 to move freely therealong at a clearance therefrom. This ram plate is shown mounted on a framework 48 which in turn is supported on roller wheels 50. These roller wheels move along a pair of respective parallel front to rear tracks 52 along opposite sides of the frame and trough to enable the ram to be moved axially forwardly toward chipping disc subassembly 40 and away therefrom during return. This ram is powered by a suitable drive means such as a pair of powered recirculating chains 51 on opposite sides of the assembly. Each chain has its opposite ends attached to the ram subassembly, and each extends around a pair of rear and front sprockets 63 and 65 adjacent the ends of tracks 52. One of the sprockets is powered as by an hydraulic motor (not shown) for forward and reverse movement of the ram. Alternative drive mechanisms could be employed.

The inside forward face of ram plate 46 preferably includes a plurality of stump penetrating, pointed projections for penetrating stumps, etc. which are being forcefully advanced by the ram.

The bottom of trough 20 (FIG. 6) has a perforate structure to allow dirt, small stones and other debris to fall out of the trough. This dirt, etc. is shaken loose from the stumps by vibration during the disintegration process conducted by the apparatus. Beneath this perforate panel is preferably an elongated helical auger for conveying this material to a suitable receptacle (not shown) or location.

Chipper Subassembly

Chipper subassembly 40 includes an upper cowl or housing 90 which is axially open toward trough 20. It contains the chipper mechanism and includes a chip discharge chute (not shown) for discharge of chips. The chipper mechanism includes a circular chipper disc 96 having a plurality of protruding chipper blades 97 mounted thereon, and a circular back plate 98 spaced behind and parallel to the chipper disc. Plate 98 is secured to the chipper disc by a plurality of radially oriented fan blades or paddles 100 spaced at circumferential intervals around the structure for throwing the chips to the discharge chute. The subassembly is mounted on an axial shaft as explained in the identified copending application.

The chipper blades are mounted at various radial locations relative to the central rotational axis of the chipper disc, preferably in two spiral series, to cover all radial portions of the disc. Each of the blades, whether steel or carbide, is mounted in a pocket adjacent an opening which extends from the front face of the chipper disc, i.e., the face toward the ram and from which the blade projects, to the rear face.

Anvil Subassembly

The anvil subassembly 101 has an anvil 102 which is uniquely capable of shifting on a slide support track 104 between an extended position adjacent the front face of disc 96 and a retracted position away from the disc. In this retracted position, the anvil is outside the confines of trough 20. Anvil 102 shifts in a direction transverse to the direction of movement of ram 46, and therefore transverse to the axis of disc 96. It is preferably a rectangularly shaped thick steel plate member which is oriented generally radially of the disc, extending over a portion of the disc radius from the outer periphery of the disc toward the center. It thus has a flat upper surface facing directly toward and located alongside the plane of the advancing blades. Its movement is shown to be in the radial direction relative to the disc, generally parallel to the plane or diameter of the disc, outwardly for anvil retraction and inwardly for anvil extension. This movement is depicted as a sliding action in a supporting slide track 104 forming a rigid peripheral support housing. The sides of the support housing control the spacing of the anvil relative to the disc face and blades. The bottom and top of the support housing secure the anvil against the force of the moving blades. More specifically, the bottom of the radially inner end of the support housing restrains the anvil against the repeated downward striking force of successive blades against the wood, while the outer end portion of the anvil is restrained by the portion of the support housing top which is radially outwardly from the inner end. Thus the anvil is prevented from twisting under force. Also the anvil has considerable thickness so as not to bend under the force encountered.

Figure 4:
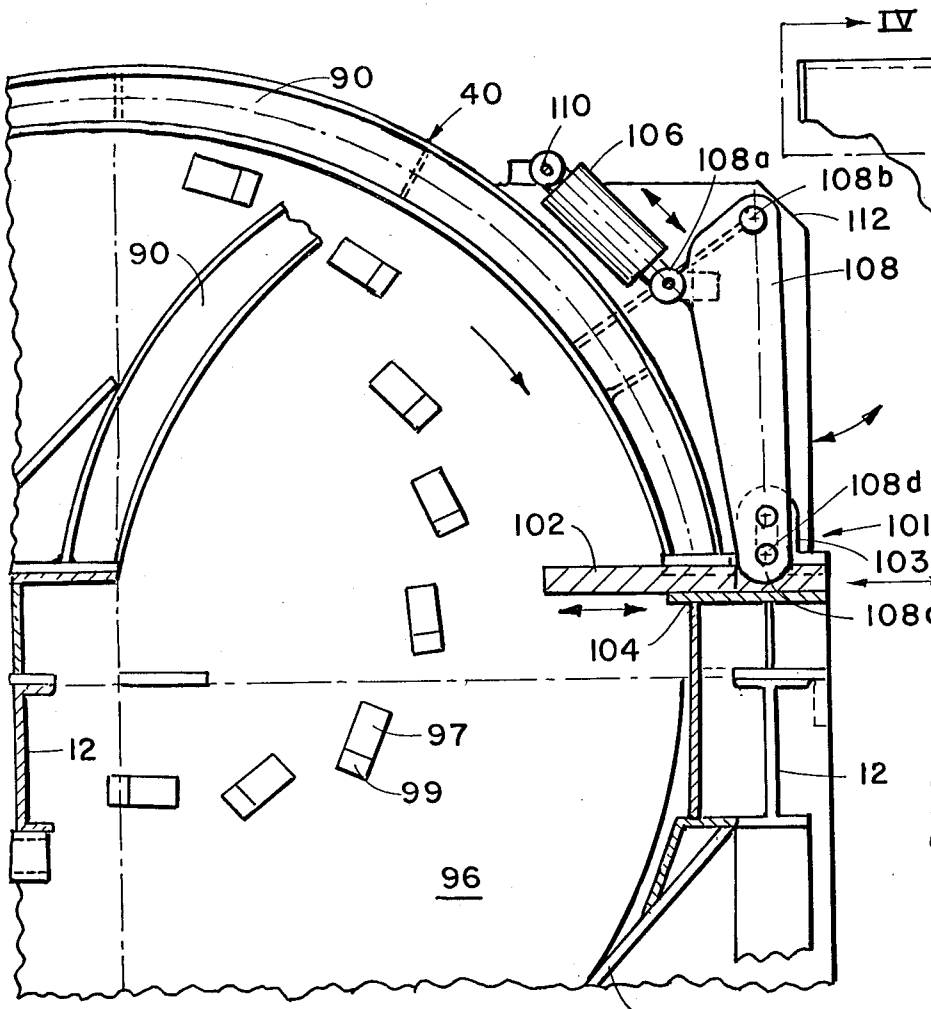
FIG. 4 is an enlarged fragmentary sectional view taken on section lines IV—IV in FIG. 3 but with the left portion being offset toward the right portion for clarity.

Shifting of the anvil is accomplished by a power actuator shown as fluid cylinder 106 connected indirectly to anvil 102 by intermediate linkage 108. One end of cylinder 106 is pivotally connected to housing 90 at 110, and pivotally connected at **108*a* to elongated link 108 intermediate its ends. Upper end 108*b* of link 108 is pivotally mounted to brackets 112 which are secured to housing 90. Lower end 108*c* of link 108 has a lost motion connection to the anvil. Specifically, a pair of parallel ears 103 extending up from anvil 102 include aligned vertically elongated slots into which the ends of pivot pin 108*d* project. This pin is attached to lower end 108*c* of the link. Extension of cylinder 106 pivots link 108 (see arcuate arrow, FIG. 4) to cause anvil 102 to be slidingly retracted from adjacent the disc, while contraction of cylinder 106 causes extension of anvil 102 to its inner position adjacent the face of disc 96**. The lost motion connection accommodates the conversion of the pivotal motion to the horizontal sliding action.

Operation

Figure 1:
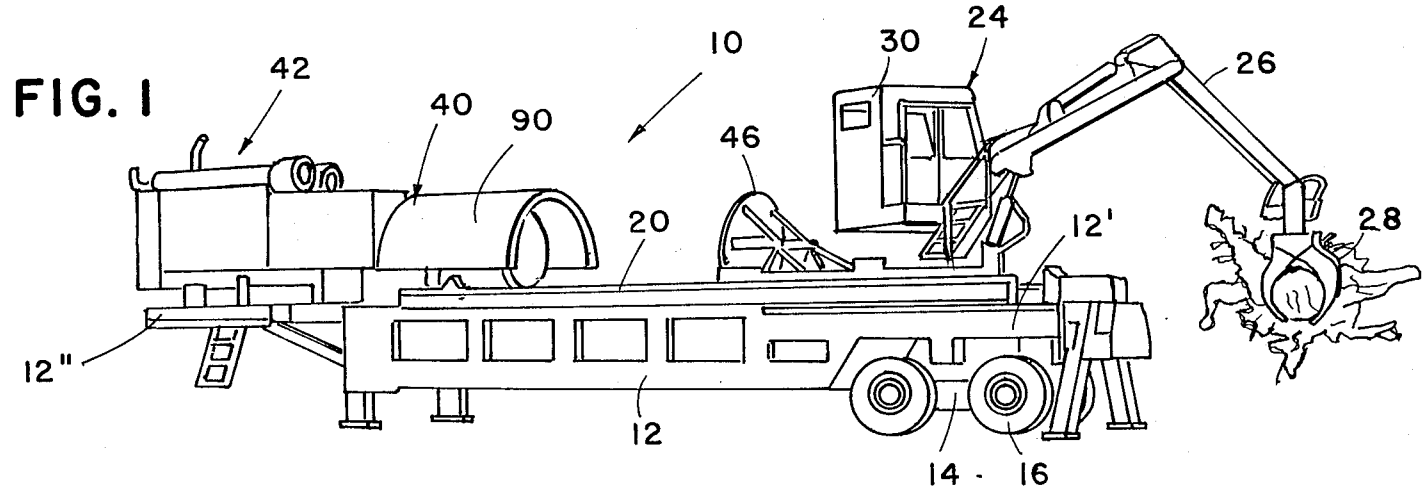
FIG. 1 is a perspective view of the chipping disintegrator.
Figure 3:
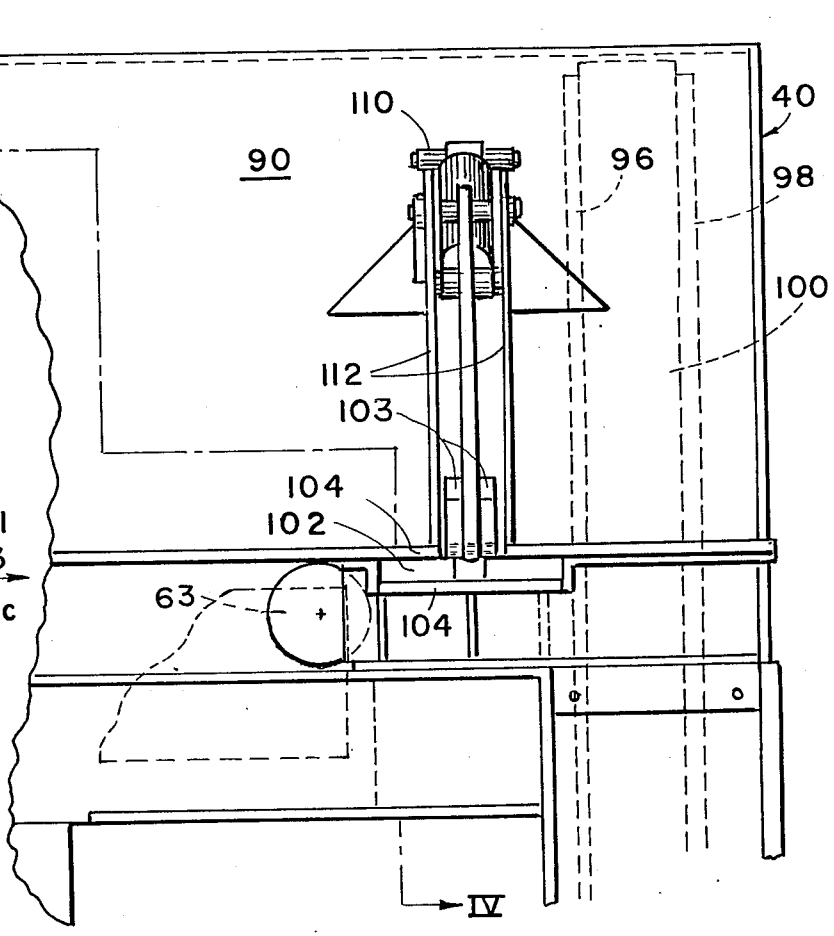
FIG. 3 is an enlarged fragmentary side elevational view of a portion of the apparatus in FIG. 1.

In operation of the novel apparatus, preferably in the mobile form illustrated in FIG. 1, it can be drawn by a suitable truck tractor to a location for chipping of stumps and the like. Alternatively, it can be placed at a central location to which stumps or the like are brought for chipping. The stumps are placed in support trough 20 by hoist 24 when ram 44 is in the retracted rearward position (FIG. 1). Power is supplied from engine 42 to the chipping disc to rotate it. The ram is advanced forwardly to push stumps, roots, etc. to the chipping disc. Frequently, the central core of the stump will be near the center region of the disc. The chipping blades remove chips of wood therefrom. These chips pass through disc 96 into the space between it and backup plate 98 where fan blades 100 propel the chips through a discharge chute. The ram assists in feeding material to the blades. The heavy radiating root sections often tend to radiate out toward the outer region of the disc.

During this chipping and disintegrating process, anvil 102 is adjacent the disc face to serve as a counter surface against which the blades force the wood, and to restrain the wood from rotating with the disc. As the ram approaches and/or reaches the end of its stroke some inches from the disc, the remaining stump structure sometimes hangs up across the face of the disc. If withdrawal of the ram does not result in the stump falling down in the trough, then it has been found to cause severe interference with further chipping of additional material placed in the apparatus. This undesirable condition has previously required manual or mechanical movement of the stump portions, such being difficult, time consuming and potentially risky.

However, by appropriate retraction of the anvil, such a stump can be dislodged to fall down in the trough where it can be subsequently chipped, either alone or along with other material, by subsequent advancement of the ram. This retraction of the anvil is actuated as the ram reaches the end of its feed stroke, to thereby remove the anvil as a restraining force on the stump. Thus the moving blades of the rotating disc tend to rotate and/or repeatedly strike the stump to dislodge it and cause it to fall. This retracting operation is readily performed by manipulation of a control in cab 30 to actuate the power cylinder 106 and thereby slide the anvil out of the trough. After the stump structure falls, the anvil is again inserted by retracting cylinder 106.

It is conceivable that those in the art may modify certain features in the illustrated preferred embodiment, while employing the inventive concept presented herein. For example, the actuator 106 for the anvil could be oriented more in alignment with the anvil, the anvil could have a different direction of movement during retraction, or the like. Therefore, it is intended that the invention set forth herein is to be limited only by the scope of the appended claims and the reasonably equivalent structures to those defined therein, rather than to the illustrated preferred embodiment.

The embodiments of the invention in which an exclusive property or privilege is claimed are defined as follows:

1. A wood and stump chipper apparatus comprising:

a rotational disc having an axis of rotation and a front face normal to said axis and from which blade means can project, and having blade means projecting from said front face for chipping wood advanced to said disc;

a support trough for wood to be advanced to said disc;

means for advancing wood along said trough to said disc, said means being movable from a position spaced from said disc to a position adjacent said disc;

an anvil adjacent said front face of said disc for cooperation with said blade means during wood chipping, and shiftable to a retracted position away from said front face of said disc; and means for advancing said anvil to a cooperative position adjacent said front face of said disc for chipping wood and for retracting said anvil from adjacent said front face of said disc.

2. The wood chipper in claim 1 including support means for said anvil;

said anvil movable on said support means between said retracted and advanced positions.

3. The wood chipper in claim 2 wherein said anvil is slidable on said support means, and including power means for shifting said anvil.

4. The wood chipper in claim 3 wherein said power means include an actuator and linkage between said actuator and said anvil.

5. The wood chipper in claim 1 wherein said anvil, when retracted, is outside the periphery of said trough.

6. A wood chipper comprising:

a rotational chipper disc having an axial face and blade means on said face for chipping wood, said disc having an axis of rotation and said axial face being normal thereto;

a support for wood to be chipped by said chipper disc;

an anvil for cooperation with said blade means;

an anvil support for said anvil; and means for shifting said anvil relative to said anvil support and said chipper disc between an extended position adjacent to and cooperative with said chipper disc and a retracted position away from said chipper disc.

7. The wood chipper in claim 6 wherein said anvil is shiftable in a direction generally normal to said axis of said disc.

8. The wood chipper in claim 6 wherein said anvil support is fixed, and said anvil is shifted on said anvil support.

9. The wood chipper in claim 6 including a ram movable in a dimension along said support toward said disc to advance wood to said disc, and away from said disc; and said anvil is shiftable in a dimension generally transverse to said ram movement dimension.

10. The wood chipper in claim 9 wherein said anvil, when in said retracted position, is out of the path of movement of said ram.

11. The wood chipper in claim 6 or 9 including power means for shifting said anvil.

12. The wood chipper in claim 9 including power means for moving said ram.

13. The wood chipper in claim 6 wherein said anvil support has side walls determining the spacing of said anvil relative to said disc, and has top and bottom walls to brace said anvil against the force of said rotational blade means.

14. The wood chipper in claim 6 wherein said support is a trough, said anvil when extended is in said trough and when retracted is out of said trough.

* * * * *